US005349715A

United States Patent [19]

Lewis, Jr.

[11] Patent Number: 5,349,715

[45] Date of Patent: Sep. 27, 1994

[54] BRUSH FABRIC CLEANER

[75] Inventor: John C. Lewis, Jr., Salisbury, Vt.

[73] Assignee: Tucel Industries, Inc., Forest Dale, Vt.

[21] Appl. No.: 941,273

[22] Filed: Sep. 4, 1992

[51] Int. Cl.[5] ..... A47L 13/12

[52] U.S. Cl. ..... 15/114; 15/187; 15/193; 15/217; 15/227; 428/90; 428/95; 428/96; 428/97; 300/21

[58] Field of Search ..... 15/116, 186, 187, 191.1, 15/192, 193, 217, 227; 300/21; 428/85, 90, 95–97

[56] References Cited

U.S. PATENT DOCUMENTS

| | | | |
|---|---|---|---|
| 1,887,477 | 11/1932 | Slater | 428/85 |
| 2,187,140 | 1/1940 | Faris et al. | 15/217 |
| 2,349,236 | 5/1944 | Bodle | 428/85 |
| 3,053,575 | 9/1962 | Zeilstra | 15/191.1 |
| 3,332,828 | 7/1967 | Faria et al. | 428/95 |
| 3,357,038 | 12/1967 | Williamson et al. | 15/187 |
| 3,392,421 | 7/1968 | Mathison | 15/104.93 |
| 3,477,763 | 11/1969 | Greichgauer | 300/21 |
| 3,633,974 | 1/1972 | Lewis, Jr. | 300/21 |
| 3,638,270 | 2/1972 | Schlegel, Jr. et al. | 15/114 |
| 3,641,610 | 2/1972 | Lewis, Jr. | 15/114 |
| 3,799,616 | 3/1974 | Lewis, Jr. . | |
| 4,741,941 | 5/1988 | Englebert et al. . | |
| 4,844,374 | 12/1989 | Natale et al. . | |
| 4,849,271 | 7/1989 | Weihrauch . | |
| 4,903,365 | 2/1990 | Kaufman | 15/110 |
| 4,912,800 | 4/1990 | Zeltner | 15/114 |
| 4,936,633 | 6/1990 | Weihrauch | 300/21 |
| 4,980,943 | 1/1991 | Barber | 15/227 |
| 5,075,918 | 12/1991 | Zeltner et al. | 15/210.1 |

FOREIGN PATENT DOCUMENTS

| | | | |
|---|---|---|---|
| 276824 | 8/1988 | European Pat. Off. | 428/85 |

OTHER PUBLICATIONS

Handsome Rewords Catalog, Feb. 1992, p. F-23399r-9.

*Primary Examiner*—David A. Scherbel
*Assistant Examiner*—Mark Spisich
*Attorney, Agent, or Firm*—Lowe, Price, LeBlanc & Becker

[57] ABSTRACT

A tufted brush article and process for manufacturing the same. The article consists of a fabric having upper and lower surfaces with tufts disposed on the upper surface and a tuft receiving member disposed integrally with the tuft on the lower surface. The tuft receiving menber typically includes a projection which registers on the tuft and extends through the fabric material. The projection is then melted and the tuft end fused so that the tuft can be mounted on the fused projection to form an integral connection.

9 Claims, 7 Drawing Sheets

FIG. 1
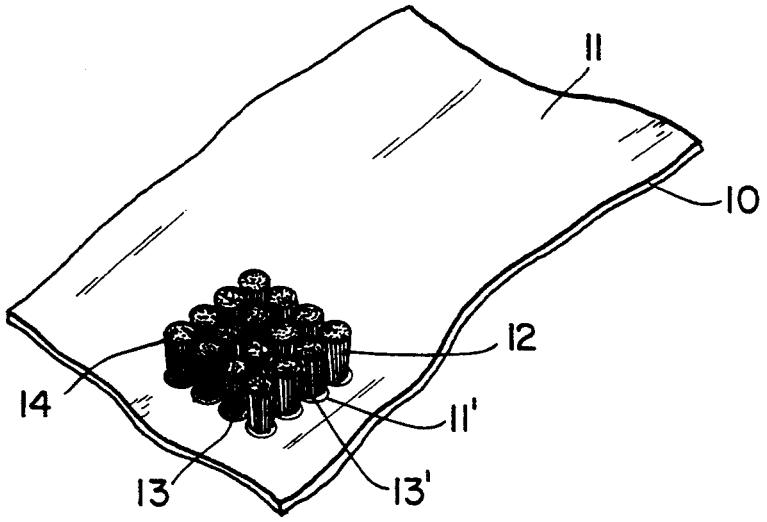
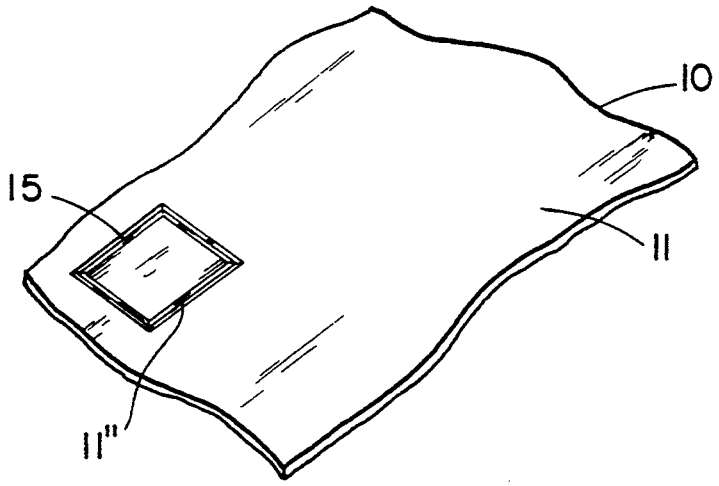
FIG. 2

BRUSH FABRIC CLEANER

FIELD OF THE INVENTION

The invention relates to natural and synthetic tufted fabrics, which when employed for cleaning and drying, allow the removal of debris and other foreign matter from any type of object.

DESCRIPTION OF THE PRIOR ART

Many types of tufted cleaning and cleaning related fabrics have been disclosed over the years, two such disclosures being U.S. Pat. Nos. 3,799,616 and 4,912,800 issued to John C. Lewis, Jr. and Barry Zeltner respectively. These patents describe a towel or fabric having brush filament tufts extending outwardly and from one surface only.

The Lewis patent discloses one or more individual filaments tufts fused directly onto a fabric or fabric-like surface without any support means except that of the filament base of the tuft being attached to the upper surface of said fabric. Without any direct connection between the individual tufts, the brush construction formed cannot be stabilized, and the working ends of the tufts do not converge in a uniform plane and are not held in said plane.

The Zeltner patent discloses a preformed fused brush whose base is then heat fused onto the upper surface of a towel. The resultant brush is merely "glued" to the towel's surface and is easily removed.

In U.S. Pat. No. 4,849,271, there is described a door mat which uses a nonwoven fibrous layer with a backing material. A depression or hole in the fibrous layer is provided to receive a tuft of bristles. The specification describes that the backing materially can be zonally melted and the end of the tuft of fibers may also be melted so that the two fuse when they cool. Similarly, in U.S. Pat. No. 4,741,941, a nonwoven web of fibers is layered on top of a sheet having projections raised therefrom.

Neither patent describes a procedure for mounting tufts on a woven fabric alone.

SUMMARY OF THE INVENTION

The instant invention overcomes the inadequacies in the prior art by providing a flexible tufted brush construction radiating from the upper or top surface of a natural or synthetic woven and/or nonwoven fabric, but actually having its filament tufts integrally connected onto a base substrate on the underside of said fabric whereby the filament tufts are locked onto the fabric located between the said base and tuft.

In this manner, the fabric and brush are essentially one, and it is impossible to separate the tufts from the fabric. This property is essential when designing a tufted fabric which can be washed in a mechanical washing machine, and then subjected to a drier device, in order to reuse the fabric over and over again, but retain the integrity of said cleaning fabric.

The improved device generally includes a molded base portion, with or without hinge-like grooves, a fabric medium and fused synthetic filament tufts integral with said base.

It is therefore an object of this invention to provide a tufted cleaning fabric device with self-supporting brush tufts radiating from the upper surface of said fabric while fused directly onto a base means located on the under side of said fabric which may be employed for brushing and cleaning any object.

Another object of this invention is to provide a heavy duty cleaning towel containing brush tufts having their working ends located on one surface of said towel and in a specific brush design whereby the tufts may be used to clean and brush away debris from an object and then immediately thereafter, wipe the said object with the towel's surface.

A further object of this invention is to provide a flexible brush construction integral with a wiping towel whereby upon flexing the said brush construction, a three-dimensional brush face results from an originally one-plane brush face dimension.

Another object of this invention is to provide a tufted mitten (glove) containing a brush construction whereby when used as a glove, the said brush portion can be so manipulated thus making the brush face conform to the surface of the object being cleaned.

Another object of this invention is to provide a method for constructing a tufted fabric device wherein the fabric portion of the device is located between the tufted brush design construction on an upper surface and the base portion of the brush located on the underside of said fabric.

These and other objects will become readily apparent with reference to the drawings and following descriptions of the device.

BRIEF DESCRIPTION OF THE DRAWINGS

FIG. 1 is a perspective view of a brush fabric cleaning device illustrating a brush;

FIG. 2 is a view of the underside of FIG. 1;

FIG. 8' is a side view of a base plate of FIG. 8 and towel prior to forming a tufted towel;

DETAILED DESCRIPTION OF THE INVENTION

Figure 3:
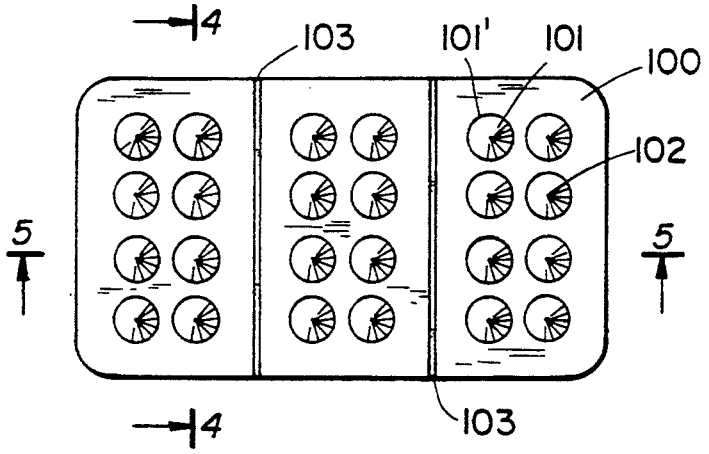
FIG. 3 is a top view of a base plate employed in the invention.

The brush fabric cleaning device of the instant invention includes a fabric body that is primarily designed to clean, dry or polish said articles and a defined group of assembled brush filament tufts fused integral with a brush tuft-supporting body member, wherein said body is flat and parallel to the underside of the fabric body while the said fused tufts are basically integral and radiating from the fabric's upper surface at about 90 degrees from the said upper surface.

FIG. 1 illustrates one such device 10 with fabric 11 having a pre-assembled group of filament tufts 12 fused at their base portion 13 and having their working ends 14 radiating at approximately 90 degrees from the surface of fabric 11. While it appears that the tufts 12 are fastened to the fabric's surface 11' at position 13, in reality, the tufts 12 are fused onto a tuft supporting member 15 on the underside of fabric 11 at or near position 11" as shown in FIG. 2.

A preferred embodiment of the invention can best be illustrated by the following drawings. A base or filament supporting member 100 of FIG. 3 shows the base member 100 prior to processing where there is base 100 having projections 101 molded integrally with base 100 at position 101' and extending in a tapering attitude upward and away from the base 100 and terminating in a tip (point) 102 at a height of approximately ⅜ inches. It should be noted that the "height" is not critical, but can range from ⅜ up to 1 inch, while the base width 9 diameter) 101' can range from ⅜ up to 1 inch, depending upon the type and size of monofilament tufts to be fused thereon. Also there is illustrated a grove 103 or "hinge-like" section molded into the base member 100 which allows portions of the base member 100 to flex along said groove 103 thus giving the base 100 an ability to have some portion of its surface's plane (attitude) changed from a flat single plane to an angled attitude. It is not a requirement that the base or filament tuft supporting member 100 have groove(s) 103, however, depending upon the desired end resulting physical properties of the tufted fabric device, grooves and/or thin sections will allow controlled flexibility of the working brush portion.

Figure 4:
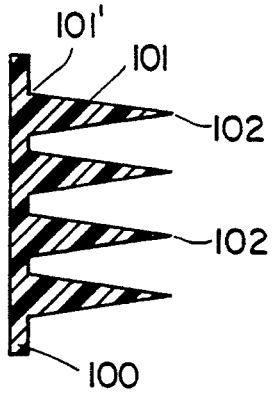
FIG. 4 is a cross-sectional view of FIG. 3 as taken along lines 4—4.
Figure 5:
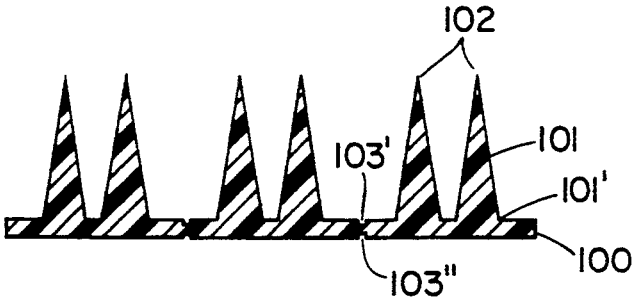
FIG. 5 is a cross-sectional view of FIG. 3 as taken along lines 5—5.

FIG. 4 is a cross-sectional view of FIG. 3 taken along lines 4—4 as is FIG. 5 taken alone lines 5—5. The groove 103 of FIG. 3 is best illustrated in FIG. 5 where the two open sections of groove 103 are shown at positions 103' and 103" respectively.

Figure 6:
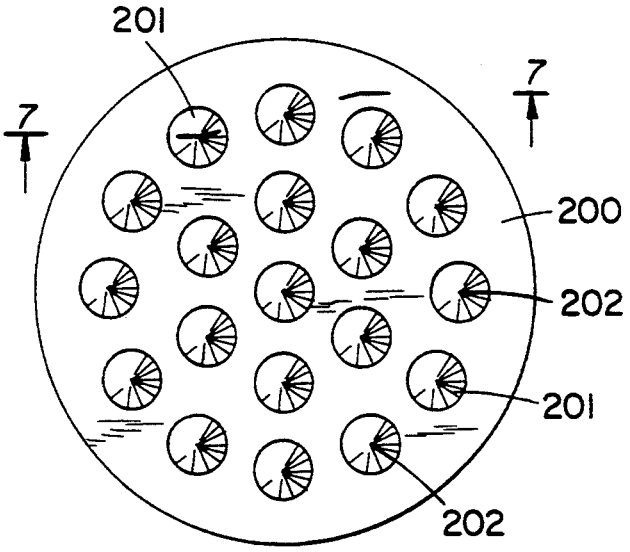
FIG. 6 is a top view of another base plate having a geometric shape in the form of a circle.
Figure 7:
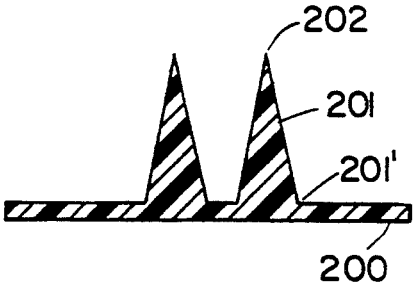
FIG. 7 is a cross-sectional view of FIG. 6 as taken along lines 7—7.

Another base portion embodiment illustrating the instant invention is shown in FIG. 6 and 7 wherein base member 200 has a more or less circular defined shape with molded integral projections 201 radiating from said base 200 at 201' and terminating at a point 202. The cross-sectional view of FIG. 7 illustrates the base portion 200 of FIG. 6 as taken along lines 7—7.

Figure 8:
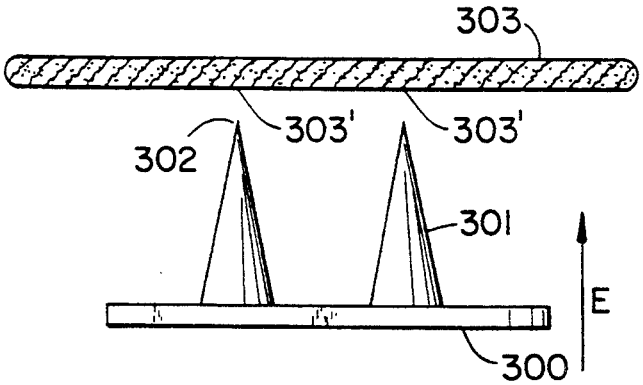
FIG. 8 is a perspective view of a base plate having two projections.
Figure 8:
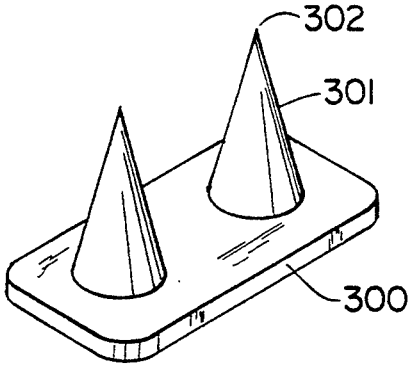
Figure 9:
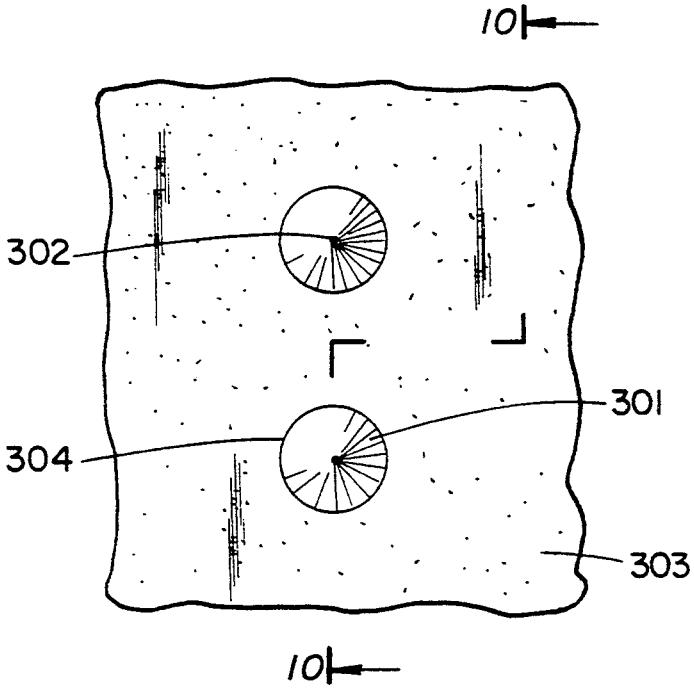
FIG. 9 is a partial top view of the base plate of FIG. 6 wherein the towel section has been overlaid.
Figure 10:
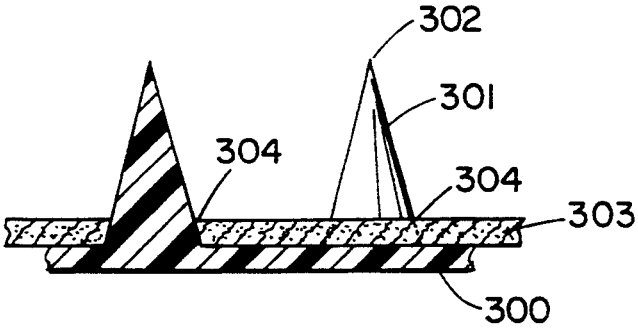
FIG. 10 is a cross-sectional view of FIG. 9 as taken along lines 10—10.

Further describing the invention, attention is drawn to FIGS. 8–15 wherein the method of manufacture and resultant brush fabric cleaner device is set forth. FIG. 8 illustrates one such molded brush base 300 prior to method and resultant tufted brush/fabric construction. In FIG. 8', the base member 300 is located under a fabric material 303, i.e., cotton towel, and the base 300 is moved toward and in the direction E in order to allow projections (points) 302 to pierce said fabric 303 at positions 303', the resultant construction is illustrated in FIGS. 9 and 10 wherein the points 302 have protruded through the fabric 303 at position 304 and the molded base 300 lies parallel and under the fabric 303. FIG. 10 illustrates the molded projection 301 in an attitude ready for fusing, as taken along lines 10—10 of FIG. 9.

Figure 11:
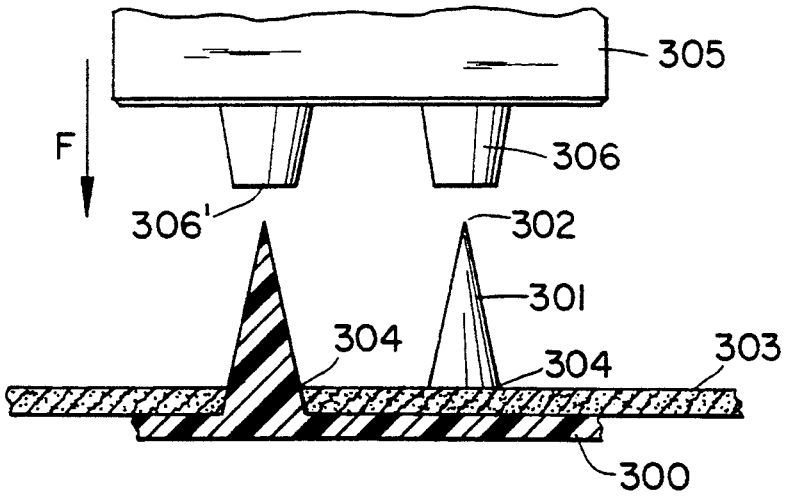
FIG. 11 is the cross-sectional view of the tufted towel of FIG. 10.
Figure 12:
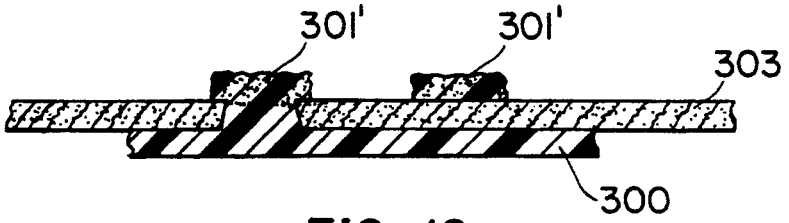
FIG. 12 is a cross-sectional view of the base portion if FIG. 11 after having been melted.
Figure 13:
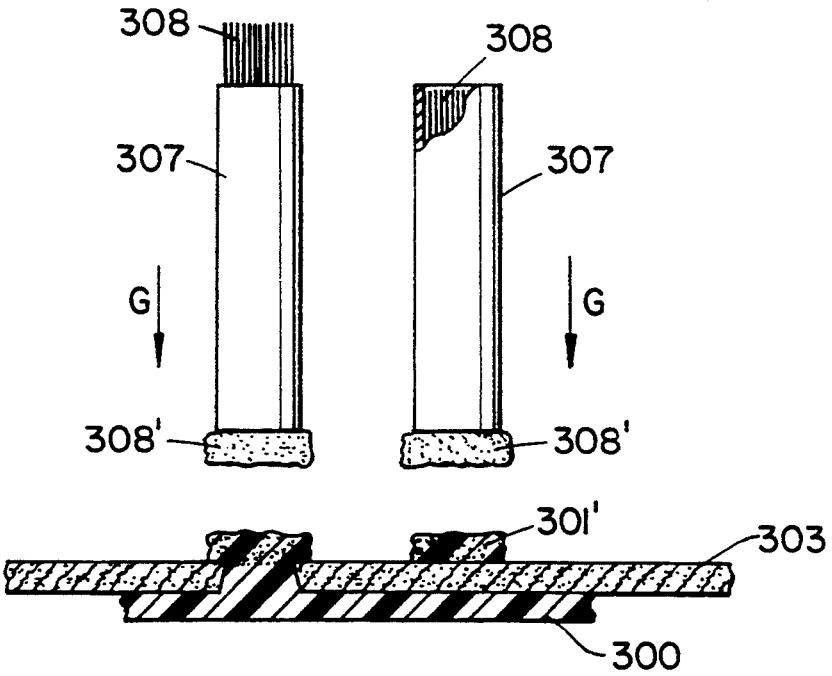
FIG. 13 is a cross-sectional view of the melted plate of FIG. 12 illustrating fusing of tufts.

FIG. 11 shows a heat melting device 305 located over the fabric/base portion 303/300 having heat melting probes 306, and in an attitude ready for indexing downward in direction F. As the heat melting device 305 is indexed in direction F, the melter probe and 306' engages the tip 302 of mold base 300 and melts down the tip 302 and main body 301 to a "pool" 301' of melted plastic as illustrated in FIG. 12.

Figure 14:
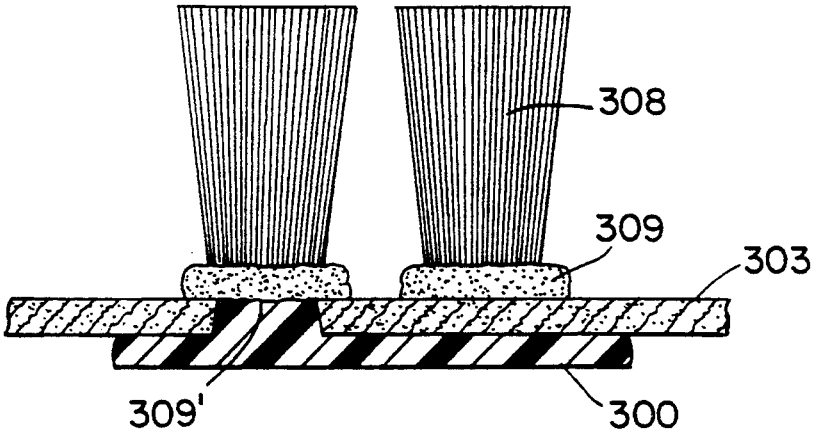
FIG. 14 is a cross-sectional view of FIG. 13 illustrating the tufts as fused.

Simultaneously, filament picking devices 307 containing filaments 308, i.e., polypropylene monofilament, and having pre-melted filament mass 308', are indexed toward and onto the premelted base portion 300 in direction G in order to fuse the filament melted mass 308' to melted probe base 301', thus creating a fused brush fabric device as shown in FIG. 14. Noting the brush fabric device of FIGS. 14 and 15 have brush filament tufts 308 radiating integral with base 300 and fused at position 309'. The fabric portion 303 is held fast between the melted tuft mass 309 and base portion 300 thus creating a brush/towel combination whereby the brush portion is located on the "top" side of the fabric (towel) and the brush base portion is located on the "bottom" side of said fabric as shown in FIG. 15.

Figure 15:
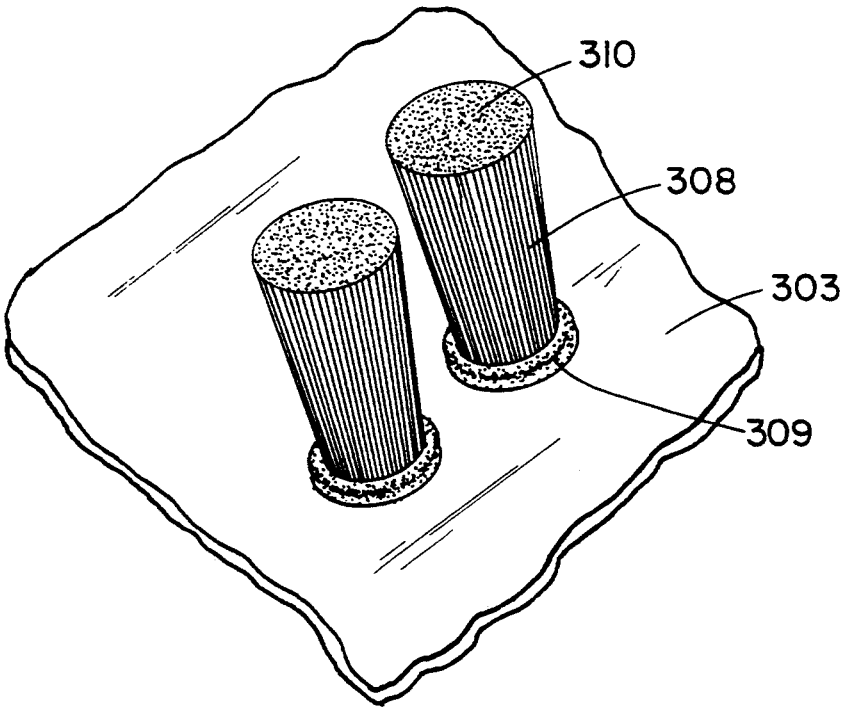
FIG. 15 is a perspective view of the construction of FIG. 14.
Figure 16:
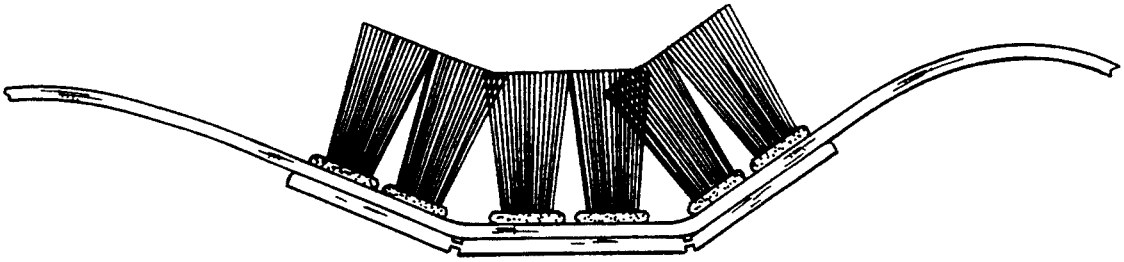
FIG. 16 is an edge view of a tufted construction illustrating converging tufts.
Figure 17:
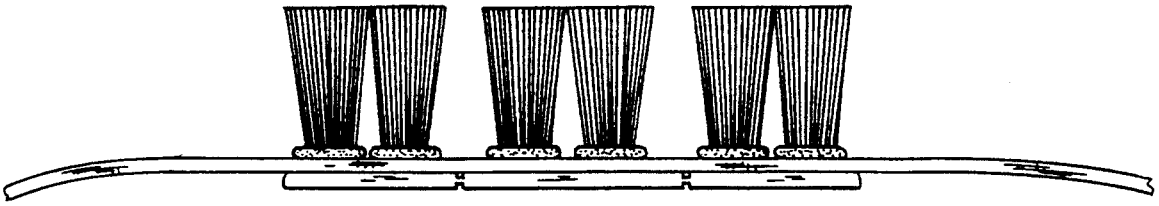
FIG. 17 is an edge view of a tufted construction illustrating a planer tuft design.
Figure 18:
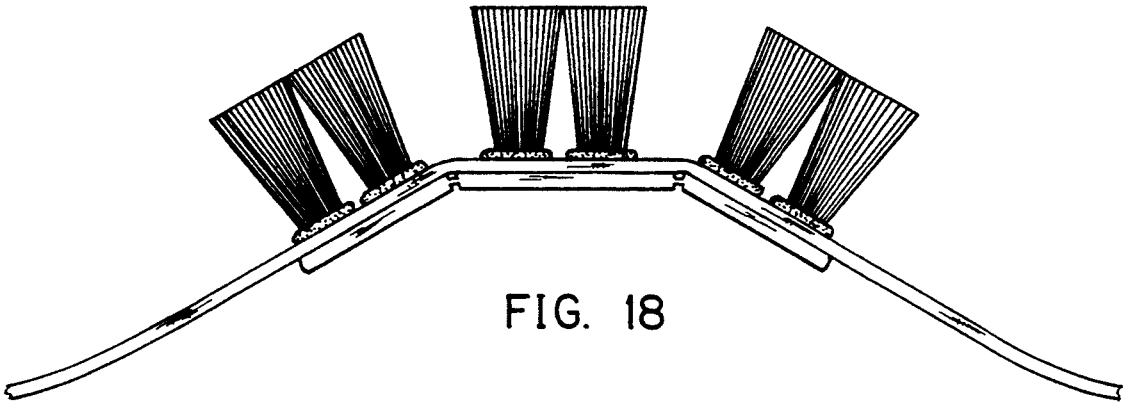
FIG. 18 is an edge view of a tufted construction.

FIGS. 15, 17, and 18 illustrate brush/fabric combinations whereby the base portion, upon being flexed, creates various flat, concave and convex brushing surfaces.

Figure 19:
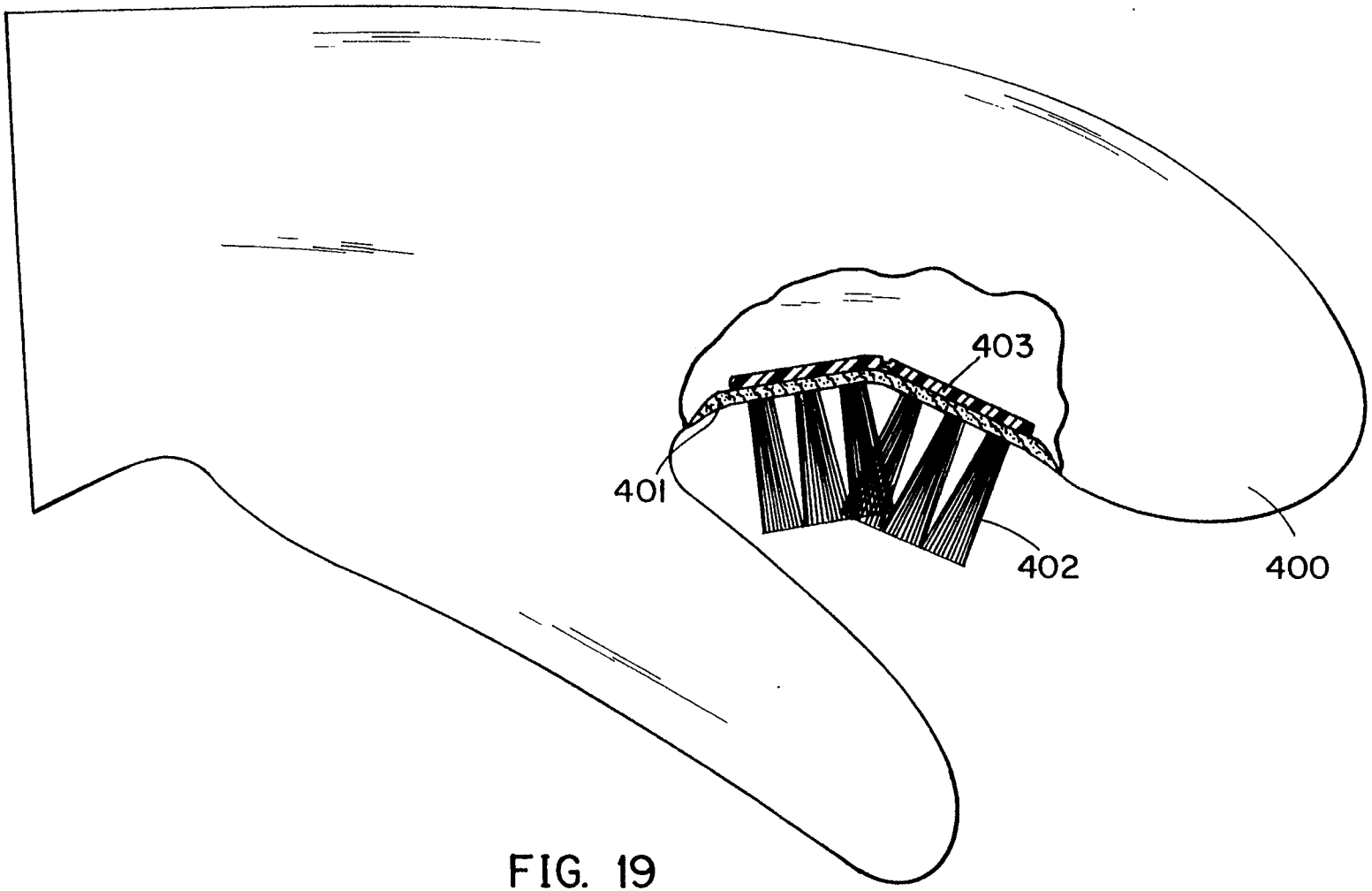
FIG. 19 is a cross-sectional view of a tufted mitten construction.

FIG. 19 illustrates a brush/mitten (fabric) combination whereby the mitten 400 contains filament tufts 402 radiating from tuft receiving member 403 with fabric 401 located between said filament and receiving member.

The instant invention is not limited to the above cited criteria, and many different brush constructions may be obtained employing the instant method for fusing molded brush base segments to assembled synthetic monofilament brush fibers. Brush/fabric combinations may range from cleaning devices employed for athletic equipment, medical and food processing equipment, personal brush/towel cleaning clothes, machinist clothes, and many other devices.

Many types of thermoplastic filaments may be used, such as, for example, polyethylene, polypropylene, polyester, polyamide and the like, while filament diameter, cross-sectional shapes, lengths, and the like may vary with the desired end result for the brush fabric cleaning device.

Various types of fabric material may be employed for the cleaning device. Both woven and nonwoven fabric materials taken from natural fibers as well as synthetic fibers can be employed without departing from the instant invention. As disclosed, the fabric is merely held physically between the filament tuft and brush mounting member.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A brush fabric combination cleaning device comprising:

a fabric body having an upper surface and an under surface, at least a first and a second parallel synthetic monofilament tufts radiating generally at 90 degrees from said fabric's upper surface;

a tuft receiving member having at least one groove running through said member's surface separating said member into two tuft sections, each of said two sections located on said fabric's under surface side directly under said tufts;

a first one of said tufts located over and integral with one of the two tuft sections;

a second tuft located over and integral with the second tuft section;

said fabric body located between said tufts and integral tuft receiving member and a portion thereof encased therein;

whereby when the device is flexed said tufts change from a parallel attitude.

2. A brush fabric combination cleaning device according to claim 1, wherein said body is:

a cotton fabric body; said tufts are polypropylene filament tufts extending from a surface of said body; and said receiving member is a molded polypropylene member integral with said tufts mounted on the opposite surface of said body.

3. A brush fabric combination cleaning device according to claim 2 wherein said device may be a golf club and ball cleaner.

4. A brush fabric combination cleaning device according to claim 1 wherein said body is a cotton fabric body; said tufts are polypropylene filament tufts mounted on one surface of said body; and said receiving member is molded polypropylene tuft receiving member having a hinge section thereon mounted on the opposite surface of said body integral with said tuft, whereby a brush fabric device is provided.

5. A brush fabric combination cleaning device according to claim 4 wherein said device may be a golf club and ball cleaner.

6. A brush fabric combination cleaning device according to claim 4 wherein said device may be a machinist's tool and die cleaner.

7. A brush fabric combination cleaning device according to claim 4 wherein said device may be a hand and body wash cloth.

8. A brush fabric combination cleaning device comprising:

a fabric body having an upper outer surface and an under surface;

at least two parallel synthetic monofilament tufts radiating generally at 90 degrees from said fabric's upper surface;

a tuft receiving member having at least one groove running through said member's surface separating said member into tuft receiving sections, each of said sections located on said fabric's under surface directly under a respective one of said tufts;

each of said tufts located over a receiving section being integral therewith said fabric body located between each of said tufts and integral tuft receiving sections;

whereby when the brush fabric is flexed said tufts change from a parallel attitude allowing said device to be a more aggressive cleaning device.

9. A brush fabric combination cleaning device according to claim 8 wherein said body is a cleaning mitten.

* * * * *